United States Patent [19]

Ando

[11] 3,976,795

[45] Aug. 24, 1976

[54] FOOD SELF-CONTAINED IN A COOKING CONTAINER AND PROCESS FOR MAKING THE SAME

[75] Inventor: Momofuku Ando, Osaka, Japan

[73] Assignee: Nissin Shokuhin Kaisha, Ltd., Japan

[22] Filed: Jan. 27, 1975

[21] Appl. No.: 544,280

Related U.S. Application Data

[63] Continuation-in-part of Ser. No. 274,066, July 19, 1972, abandoned.

[30] Foreign Application Priority Data

Dec. 25, 1971 Japan ..... 47-1932[U]

[52] U.S. Cl. ..... 426/115; 206/217; 206/497; 229/1.5 B; 426/123; 426/124; 426/396; 426/412

[51] Int. Cl.[2] ..... B65D 3/06; B65D 65/00; B65B 25/22

[58] Field of Search ..... 426/396, 394, 398, 106, 426/115, 123, 124, 126, 127, 86; 206/217, 497; 229/1.5 B, DIG. 12; 220/9 F

[56] References Cited

UNITED STATES PATENTS

| | | | |
|---|---|---|---|
| 3,227,273 | 1/1966 | Syverson et al. | 229/1.5 B |
| 3,360,382 | 12/1967 | Miller | 426/398 |
| 3,471,075 | 10/1969 | Wolf | 229/1.5 B |
| 3,561,664 | 2/1971 | Palmer | 229/1.5 B |
| 3,606,136 | 9/1971 | Hegardt | 229/1.5 B |
| 3,618,751 | 11/1971 | Rich | 426/115 |
| 3,625,785 | 12/1971 | Holmstrom | 229/1.5 B |
| 3,677,774 | 7/1972 | Rausing | 426/412 |
| 3,681,092 | 8/1972 | Titchenal et al. | 426/412 |
| 3,696,987 | 10/1972 | Schuff | 229/1.5 B |
| 3,746,160 | 7/1973 | Thompson | 229/DIG. 12 |

*Primary Examiner*—Steven L. Weinstein
*Attorney, Agent, or Firm*—Armstrong, Nikaido & Wegner

[57] ABSTRACT

Dehydrated instant-cooking food contained in a self-cooking container heat-insulated and easy to handle by hand, fitted with a laminated, rigid or semi-rigid top cover, with aluminum foil laminated to the underside, all wrapped with a heat-contractible film, for example, polyvinyl chloride, having a low ventilating nature. Preferably the top cover is provided with a projecting portion permitting easy, partial or total removal of the top cover. Also disclosed is a method for making the same.

4 Claims, 2 Drawing Figures

FOOD SELF-CONTAINED IN A COOKING CONTAINER AND PROCESS FOR MAKING THE SAME

This application is a continuation-in-part of application Ser. No. 274,066, filed July 19, 1972 now abandoned.

BACKGROUND OF THE INVENTION

This invention relates to a structure of dehydrated instant-cooking foodstuff self-contained in cooking containers and designed for long period of storage and easy handling by hands.

In the prior art, a big disadvantage in cooking soup of various kinds, including clear soup and pottage, zo-sui (a porridge of rice, vegetables and other ingredients), chazuke (rice and tea mixed) and noodles, has been that cooking and serving utensils such as pans, pots, saucers and bowls have been required.

To overcome this disadvantage, in treating instant-cooking noodles, the noodles have been placed into a foamed-polystyrene container shaped similar to a serving bowl, which is subsequently covered at the top thereof with an easy perforatable film. A heat-contractible film is thereafter applied to the container's upper periphery to yield the final containerized structure.

In order to house ordinary instant-cooking noodles on the market (around 3 centimeters thick and around 11 centimeters in diameter), however, the container has taken the shape of a large serving bowl with a wide upper opening. When handled and served for eating, the container necessarily is apt to be disfigured and invites spillage of the hot contents. Thus, handling of the bowl-like container is not only difficult thereby adding up to the difficulties of holding the bowl by hands but dangerous.

Further, the covering of the container with a film only about its upper periphery permits the instant-cooking noodles to take in moisture and the oil in the food to be oxidized due to the ventilating properties of foamed polystyrene. It is therefore apparent that such containers have reduced storability.

Moreover, the foamed-polystyrene containers get dirty easily from atmospheric dust attracted by static electricity. The drop in the container's sanitary and market value is clear.

Other disadvantages also result when boiling water is poured into the container torn partly at its top opening. The attendant drop in the best-coefficient accompanied by contamination with dust and other alien particles in the atmosphere are unsanitary and most undesirable.

Finally, thin films of plastic material which have been employed in the past to provide airtight closure of containers have the disadvantage of being fragile and easily punctured and do not permit the application of writing, such as instructions or identification thereon.

SUMMARY OF THE INVENTION

The purpose of the present invention is to overcome all the shortcomings of the conventional types of food described in the foregoing. To this end, the present invention offers a containerized, instant-food item comprising: a container of a sufficiently small diameter to permit easy gripping and holding by a single hand; a dehydrated, instant-cooking food disposed in said container; a top cover sealed in an airtight manner over the top of said container; and a substantially non-ventilating, heat-contractible film completely enclosing in a substantially air-tight manner said container and said top cover. Preferably, the top cover is heat-sealed to said container.

Advantageously, the top cover has the same diameter as the outer diameter of the top of said container with the said non-ventilating film extending thereover into sealable contact with the exterior of said container. According to a further preferred embodiment of the invention, the top cover includes a projecting portion jutting radially beyond the edge of said container whereby said top cover can be partially or totally removed by lifting said projecting portion. A particularly suitable top cover material is aluminum foil laminated to paper or cardboard so as to provide a rigid or semi-rigid top with the aluminum foil on the underside. Such a top cover has the advantage of providing a strong, secure closure which can have instructions, identification or other writing on the upper paper surface while the underside has a non-ventilating aluminum foil surface for retaining heat and sealing the container. The heat-contractible film which enclosed the entire container is preferably polyvinyl chloride.

The present invention is further directed to a method for producing a containerized, instant-food item comprising: providing a container of sufficiently small diameter to permit easy gripping and holding by a single hand; disposing a dehydrated, instant-cooking food in said container; heat-sealing a top cover over the opening of said contaner; and enclosing said container and top cover with a substantially non-ventilating, heat-contractible film. Preferably, the enclosing step comprises covering the exterior of said container and top cover with said heat-contractible film; perforating the portion of said heat-contractible film adjacent said top cover with at least one small opening for permitting air egress; and heat contracting said heat-contractible film into an air-tight adhering relationship with said container and said top cover.

BRIEF DESCRIPTION OF THE DRAWING

Other objects, features and advantages of the present invention will become more apparent from a study of the following specification when taken in conjunction with the accompanying drawings of a preferred embodiment in which.

DETAILED DESCRIPTION

Figure 1:
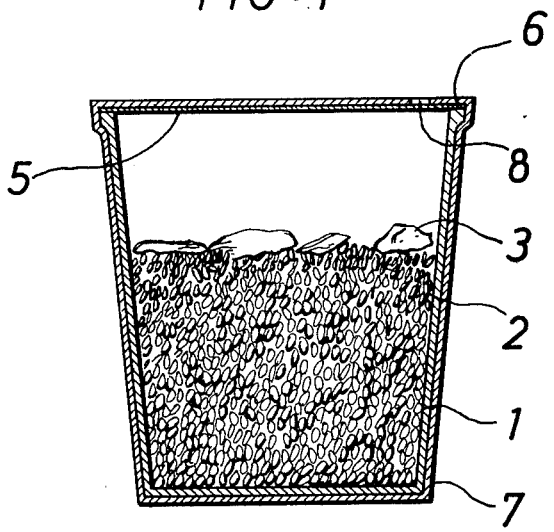
FIG. 1 is a longitudinal cross-sectional side view of a cup-shaped cooking container according to said preferred embodiment.
Figure 2:
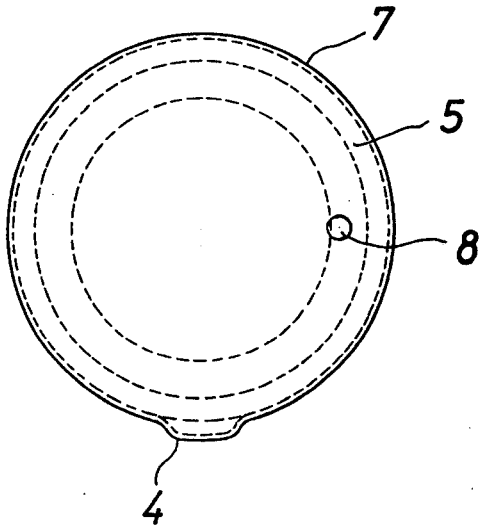
FIG. 2 is a horizontal cross-sectional plane view of the cooking container of FIG. 1.

Referring to the drawings, a heat-insulated, cup-shaped container 1 according to the present invention is designed for easy handling by hand (either a foamed polystyrene container or a paper cup covered with insulating materials) and suitably contains instant-cooking food such as seasoned gelatinized rice 2 and dehydrated vegetables or meat 3.

After container 1 is provided with the appropriate food, top cover 5 with the same diameter as that of the outer diameter of the container opening, being laminated on its underside with preferably aluminum foil 6 and advantageously having projecting part 4 at one place thereof, is placed on the opening of container 1. The aluminum foil laminate is then heat-sealed with the upper edge of the cup body 1 by, for example, a round heat-sealer. Subsequently heat-contractible film 7 larger than and covering the cup 1, is sealed around container 1 and top cover 5 in loose fashion (not skin tight). After perforating the portion of film 7 above the aluminum foil with at least one small opening 8 to permit an egress of air sealed therebeneath, film 7 is heat-contracted to adhere airtight to container 1.

When container 1 is wrapped with heat-contractible film 7 having substantially no or very little ventilation properties (such as a polyvinyl chloride film) in the way as described above, food storability is at least 6 months longer than that of a container covered with film only at the periphery of the upper opening.

The inventor has also discovered that the same method and container are applicable to specifically-dehydrated noodle soup, instant-cooking noodles, porridges of rice and vegetables and pottage and the like.

At the time of cooking the instant cooking food prepared in accordance with the present invention, the container is preferably held by one hand, contractible film 7 is ripped open, and projecting part 4 of the aluminum-laminated top cover is pulled open only enough to pour boiling water therein. After water is added to the food, projecting part 4 is returned to its former position and the food subjected for several minutes to the restoration effects of the water. The top cover is then removed to offer a fully restored food suitable for eating.

According to the present invention, the food thus produced is extremely sanitary and has extended storability. The container housing the food can be easily held by one hand without fear of accident or burning.

It is thus seen that the present invention offers an excellent outdoor stand-up meal utilizable as a snack at railroad stations, ball parks and public parks. At home the invention requires no serving utensils necessitating washing and other troublesome chores after eating.

While a preferred embodiment of the present invention has been described above, it is readily apparent to those who are skilled in the art that modifications and alterations thereof can be made without deviating from the principles of the present invention set forth in the following claims.

What is claimed is:

1. A containerized instant-food item comprising:

a. a foamed polystyrene container having a portion of sufficiently small diameter to permit easy gripping and holding by a single hand;

b. a dehydrated, instant-cooking food which is cooked by the action of hot water disposed in said container;

c. a laminated semi-rigid top cover having on its underside an aluminum foil film and having the same diameter as the outer diameter of said container, said top cover being substantially co-extensive with and in sealable, air-tight contact with the top of the container, said top cover including a projecting portion extending beyond the edge of said cover, said projecting portion permitting partial removal of said cover for the insertion of hot water to cook the food and restoration of the said cover to its original position during cooking by the action of the water; and d. a substantially non-ventilating, heat-contracted film substantially completely enclosing in a substantially air-tight manner said container and said top cover, the portion of the heat-contracted film covering the top cover including a small opening to provide for the substantially complete removal of air from between the film and the container during heat-contraction.

2. An item according to claim 1, wherein said heat-contractible film is polyvinyl chloride.

3. A method for producing a containerized, instant-food item comprising:

providing a foamed polystyrene container having a portion of sufficiently small diameter to permit easy gripping and holding by a single hand;

disposing a dehydrated, instant-cooking food which is cooked by the action of hot water in said container;

placing a laminated top cover having aluminum foil film layer on its underside and which is the same diameter of said container over the opening of said container said top cover including a projecting portion extending beyond the edge of said cover, said projecting portion permitting partial removal of said cover for the insertion of hot water to cook the food and restoration of the said cover to its original position during cooking by the action of the water;

heat sealing said aluminum foil film to the top of said container;

enclosing said container and top cover with a substantially non-ventilating, heat-contractible film in an air-tight manner;

perforating the portion of said heat-contractible film covering said top cover with at least one small opening for permitting the substantially complete removal of air from between the film and container during heat contraction; and heat contracting said heat-contractible film into a close, air-tight contact with said container and said top cover.

4. A containerized instant-food item comprising:

a. a paper container covered with heat insulating material and having a portion of sufficiently small diameter to permit easy gripping and holding by a single hand;

b. a dehydrated, instant-cooking food which is cooked by the action of hot water disposed in said container;

c. a laminated semi-rigid top cover having on its underside an aluminum foil film and having the same diameter as the outer diameter of said container, said top cover being substantially co-extensive with and in sealable, air-tight contact with the top of the container, said top cover including a projecting portion extending beyond the edge of said cover, said projecting portion permitting partial removal of said cover for the insertion of hot water to cook the food and restoration of the said cover to its original position during cooking by the action of the water; and d. a substantially non-ventilating, heat-contracted film substantially completely enclosing in a substantially air-tight manner said container and said top cover, the portion of the heat-contracted film covering the top cover including a small opening to provide for the substantially complete removal of air from between the film and the container during heat-contraction.

* * * * *

Disclaimer 3,976,795.—*Momofuku Ando,* Osada, Japan. FOOD SELF-CONTAINED IN A COOKING CONTAINER AND PROCESS FOR MAKING THE SAME. Patent dated Aug. 24, 1976. Disclaimer filed Oct. 21, 1981, by the assignee, *Nissin Shokuhin Kaisha, Ltd.*

Hereby enters this disclaimer to claims 1 through 4 of said patent.

[*Official Gazette December 15, 1981.*]